US007197967B2

(12) United States Patent
Crawford

(10) Patent No.: US 7,197,967 B2
(45) **Date of Patent: *Apr. 3, 2007**

(54) LOCKNUT PLIERS

(75) Inventor: Bruce Allan Crawford, Cookeville, TN (US)

(73) Assignee: Channellock, Inc., Meadville, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/784,841

(22) Filed: Feb. 23, 2004

(65) Prior Publication Data

US 2004/0163506 A1 Aug. 26, 2004

Related U.S. Application Data

(60) Provisional application No. 60/449,104, filed on Feb. 24, 2003.

(51) Int. Cl.
*B25B 7/02* (2006.01)
*B25B 13/48* (2006.01)

(52) U.S. Cl. ..... 81/426.5; 81/426; 81/176.1

(58) Field of Classification Search ..... 81/418–424, 81/424.5, 426, 427, 426.5, 176.3, 332, 176.1, 81/324, 331
See application file for complete search history.

(56) References Cited

U.S. PATENT DOCUMENTS 1,692,911 A * 11/1928 Vaughn ..... 81/426.5
1,751,074 A * 3/1930 Gagne ..... 81/176.1
1,782,364 A * 11/1930 Nation ..... 81/426
2,519,073 A * 8/1950 Schaub ..... 81/176.3
4,483,220 A 11/1984 Shindelar
4,513,642 A * 4/1985 Castner et al. ..... 81/52
4,870,876 A * 10/1989 Rodriquez ..... 81/426.5
5,237,715 A 8/1993 Bane, III
5,347,891 A 9/1994 Kamp et al.
5,469,766 A 11/1995 Hodges
5,525,511 A 6/1996 Taka's
5,595,094 A * 1/1997 Negus ..... 81/3.44
6,058,813 A 5/2000 Bryant et al.
6,202,517 B1 * 3/2001 Dolan ..... 81/418
6,321,625 B1 11/2001 Fernandez
2004/0074346 A1 * 4/2004 Schmidt ..... 81/176.15

* cited by examiner

*Primary Examiner*—D. S. Meislin
(74) *Attorney, Agent, or Firm*—Lackenbach Siegel, LLP

(57) ABSTRACT

The present invention is a hand tool comprising a pair of handles that rotate about a pivot point. The proximal end of the handles may be covered in an electrically insulating material in order to aid in insulating the hands of the user from electrical shock and cushion the grip of the tool. A jaw member of thin cross-section may be affixed to the distal end of the handles or formed in the distal end of the handles. The unique shape of the portion of each jaw member grips the locknut. Each jaw member is designed in such a manner that, when the hand tool's handles are closed, each jaw member independently engages one or more of the locknut protrusions. A method of tightening and loosening locknuts using a hand tool with the distal end of the handles forming a shaped jaw member for gripping the locknut.

9 Claims, 7 Drawing Sheets

LOCKNUT PLIERS

RELATED APPLICATIONS

This application is related to U.S. patent application Ser. No. 60/449,104, titled "Conduit fitting locknut pliers", filed with the U.S. Patent and Trademark Office on Feb. 24, 2003, which is incorporated by reference herein in its entirety.

BACKGROUND (1) Technical Field

The present invention relates to a hand tool and a method for using a hand tool for tightening and loosening various styles of locknuts, including locknuts that are used to secure conduit fittings to electrical junction boxes.

(2) Discussion

As depicted in FIG. 1, when wiring residential and commercial structures, it is common to encounter electrical junction boxes 10 and various conduit fittings 12 that interface with them. Although these conduit fittings 12 are designed in differing ways and serve varying purposes, many incorporate external threads as a means to secure them to the electrical junction boxes 10. These threaded conduit fittings 12 are commonly attached to electrical junction boxes 10 by placing the threaded portion of the conduit fitting 12 through a hole 14 in the electrical junction box 10 that was created by removing one of the boxes' knockouts. A locknut 16 is then screwed onto the exposed thread of the conduit fitting 12. Once the locknut 16 is screwed onto the threaded portion of the conduit fitting 12, some means of tightening the locknut 16 must be utilized in order to firmly secure the conduit fitting 16 to the electrical junction box 10.

These locknuts 16 come in a wide variety of shapes and sizes; however, certain design features make them a unique and difficult fastener to apply. First, their cross-section is usually very thin compared to their diameter. This feature makes them difficult to grasp with conventional tools. Second, because of their thin cross-section, they usually have protrusions or lugs extending from their outer diameter to make them easier to tighten or loosen. However, these lugs make it difficult for conventional tools to be applied to the locknut 16 in order to tighten or loosen it. Third, many styles of these locknuts 16 are produced by a stamping process which leaves rounded surfaces on the locknut 16 and protruding lugs, thus making it even harder to obtain a good grip on the locknut 16. Fourth, the confines of electrical junction boxes 10 can become quite cramped for space once the various conduit fittings 12 and their corresponding wire bundles have been inserted. It can become extremely difficult to acquire access for manipulating the locknuts 16 under these conditions.

Heretofore locknuts 16 have been tightened and loosened utilizing hand tools such as pliers, screwdrivers, and wrenches. Most often the particular type of pliers known as CHANNELLOCK® pliers is used. The use of conventional hand tools and CHANNELLOCK® pliers in particular, to tighten and loosen the locknut 16 is problematic. This procedure often results in stripping the projections from the exterior of the locknut 16 which renders the locknut 16 difficult to remove. A related problem involves slippage between the CHANNELLOCK® pliers and the locknut 16 which can lead to damage to parts and equipment and injury to the operator. A cylindrical tool with cylindrical opening has been attempted in U.S. Pat. No. 6,321,625 titled Wrench for Myers Nut, where the cylinder opening of the tool is matched to the dimensions of the cylinder. However, this tool has several drawbacks including the requirement of a number of cylinders for the different size locknuts, the wrench is too large to fit into many tight confined spaces, and the wires cannot be in the fitting when the wrench is used. Another tool available for tightening locknuts is a spanner wrench that has only one jaw and one handle. However, the disadvantage with this tool is that the tool only connects with one lug and one side of lug or protrusion. This again can result in slippage and damage to the locknut 16 and other parts.

There is a need for a hand tool that has: 1) a unique profile shape cut into each jaw member of the hand tool enabling the jaw members to grip and securely hold a wide variety of shapes and sizes of conduit fitting locknuts, therefore, one hand tool can be used to manipulate all locknuts whose diameters fit within the range of opening of the two jaw members; 2) a thin cross-section of both the handles and their attached or integral jaw members enhance the user's ability to utilize the hand tool in confined spaces; 3) the shape of handles that allows both right-handed and left-handed persons to utilize the tool equivalently; 4) the profile shape cut into each jaw member in combination with the shape and thin cross-section of the handles that allows the user to tighten or loosen locknuts regardless of which way the pivot axis of the hand tool is oriented with respect to the axis of rotation of the locknut; and 5) jaw members that can be presented to the locknut perpendicular to the axis of rotation of the locknut and surround it, so that the hand tool can be used to tighten and loosen locknuts even when wires have already been passed through a conduit fitting.

SUMMARY OF THE INVENTION

The present invention is a hand tool that has: 1) a unique profile shape cut into each jaw member of the hand tool enabling the jaw members to grip and securely hold a wide variety of shapes and sizes of conduit fitting locknuts, therefore, one hand tool can be used to manipulate all locknuts whose diameters fit within the range of opening of the two jaw members; 2) a thin cross-section of both the handles and their attached or integral jaw members enhance the user's ability to utilize the hand tool in confined spaces; 3) the shape of handles that allows both right-handed and left-handed persons to utilize the hand tool equivalently; 4) the profile shape cut into each jaw member in combination with the shape and thin cross-section of the handles that allows the user to tighten or loosen locknuts regardless of which way the pivot axis of the hand tool is oriented with respect to the axis of rotation of the locknut; and 5) jaw members that can be presented to the locknut perpendicular to the axis of rotation of the locknut and surround it, so that the hand tool can be used to tighten and loosen locknuts even when wires have already been passed through a conduit fitting.

The present invention is a hand tool and a method to facilitate the tightening and loosening of the various styles of locknuts that are used to secure conduit fittings to electrical junction boxes. It consists of two handles, joined together at a pivot point that provides a means for one handle to pivot radially with respect to the other about the pivot point. The distal end of each handle consists of a uniquely designed jaw member that, when applied to the circumference of a conduit locknut by virtue of the user grasping and compressing the handles near their proximal ends, provide a means to securely grip the locknut and its projecting lugs in a manner sufficient to allow the user to impart a torque to the locknut to either tighten or loosen it. A spring or other such mechanical device may serve to maintain the jaws of the tool in an open position during use. A locking mechanism may be incorporated into the design of the handles to provide a means of securing the tool in its most compact configuration for storage. An electrically insulating compliant material may cover or be incorporated into the design of the handles to cushion the user's grip, aid in protection from electrical shock, and provide an ergonomic gripping surface.

It is a primary object of the present invention to provide a hand tool and a method for tightening and loosening locknuts. The hand tool of the present invention, in one embodiment, comprises a hand tool for tightening and loosening locknuts. The hand tool comprises a handle comprising a distal end, and a proximal end; a second handle comprising a distal end of the second handle, and a proximal end of the second handle, wherein the proximal end of the first handle and the proximal end of the second handle are used for holding the hand tool and applying a gripping force; a pivot point that joins the first handle and the second handle for rotating the first handle and the second handle about the pivot point; a shape formed on the distal end of the first handle for gripping the locknut; and a second shape formed on the distal end of the second handle for firmly gripping and rotating the locknut.

Another embodiment of the present invention may further include a hand tool for tightening and loosening locknuts wherein a straight configuration is incorporated into design of the first handle and the second handle.

In another embodiment, the present invention comprises a hand tool for tightening and loosening locknuts wherein an offset is incorporated into the design of the first handle and the second handle to provide additional clearance for the user's hand in confined spaces or tight quarters.

In yet another embodiment or aspect, the present invention comprises a hand tool for tightening and loosening locknuts wherein the first handle includes an insulating material covering the proximal end of the first handle and the second handle includes an insulating material covering the proximal end of the second handle for aiding in insulating the hands of the user from electrical shock, providing an ergonomic gripping surface, and cushioning the grip of the hand tool while in use.

Another embodiment of the present invention may further include a hand tool for tightening and loosening locknuts wherein first handle includes a jaw member attached to the distal end of the first handle wherein the first unique shape is formed in the jaw member and the second handle includes a second jaw member attached to the distal end of the second handle wherein the second unique shape is formed in the second jaw member.

In another embodiment, the present invention comprises a hand tool for tightening and loosening locknuts further comprising a spring incorporated into the hand tool between the first handle and second handle to maintain the handles in a normally open position;

Another embodiment of the present invention may further include a hand tool for tightening and loosening locknuts further comprising a locking mechanism attached to the tool between the first and second handle to maintain the handles in a closed or locked position;

The present invention also comprises the provision of a method for tightening and loosening locknuts using a hand tool comprising a pair of handles, attached at a pivot point with a distal end of each end handle forming a shaped jaw member for gripping the locknut, the method comprising: grasping the pair of handles of the hand tool; orienting the hand tool so as to make an axis that passes through the pivot point of the hand tool parallel to an axis of rotation of the locknut to tighten or loosen the locknut; maneuvering the hand tool so as to place the jaw members around the locknut in order to make the jaw members grip around the circumference of the locknut and engage any protrusions extending from the periphery of the locknut; gripping the pair of handles of the hand tool to firmly hold the locknut in the jaw members; rotating the locknut about its axis while maintaining the gripping on the pair of handles of the hand tool; and repeating the rotating of the locknut in small increments, as necessary due to the crowded confines.

Another embodiment of the present invention may further include a method of tightening and loosening locknuts used to secure a electrical conduit fitting using a hand tool comprising a pair of handles, attached at a pivot point with a distal end of each end handle forming a shaped jaw member for gripping the locknut, the method comprising: grasping the pair of handles of the hand tool; orienting the hand tool so as to make an axis that passes through the pivot point of the hand tool parallel to an axis of rotation of the conduit fitting and locknut to tighten or loosen the locknut; maneuvering the hand tool so as to place the jaw members around the locknut in order to make the jaw members grip around the circumference of the locknut and engage any protrusions extending from the periphery of the locknut; gripping the pair of handles of the hand tool to firmly hold the locknut in the jaw members; rotating the locknut about its axis while maintaining the gripping on the pair of handles of the hand tool; and repeating the rotating of the locknut in small increments, as necessary due to the normally crowded confines of typical electrical boxes.

BRIEF DESCRIPTION OF THE DRAWINGS

The objects, features and advantages of the present invention will be apparent from the following detailed descriptions of various aspects of the invention in conjunction with reference to the following drawings, where.

DETAILED DESCRIPTION

The present invention is a hand tool and a method designed to facilitate the tightening and loosening of various styles of locknuts. The locknuts may be used to secure conduit fittings to electrical junction boxes. The following description, taken in conjunction with the referenced drawings, is presented to enable one of ordinary skill in the art to make and use the invention and to incorporate it in the context of particular applications. Various modifications, as well as a variety of uses in different applications, will be readily apparent to those skilled in the art, and the general principles defined herein, may be applied to a wide range of aspects. Thus, the present invention is not intended to be limited to the aspects presented, but is to be accorded the widest scope consistent with the principles and novel features disclosed herein. Furthermore, it should be noted that, unless explicitly stated otherwise, the figures included herein are illustrated diagrammatically and without any specific scale, as they are provided as qualitative illustrations of the concept of the present invention.

(1) Introduction

The present invention includes a hand tool and a method to facilitate the tightening and loosening of the various styles of locknuts especially locknuts that are used to secure conduit fittings to electrical junction boxes. The hand tool is capable of manipulating various and uniquely designed forms of conduit fitting locknuts as well as a variety of other fasteners of thin cross section and/or of unique shape.

(2) Discussion

Figure 1:
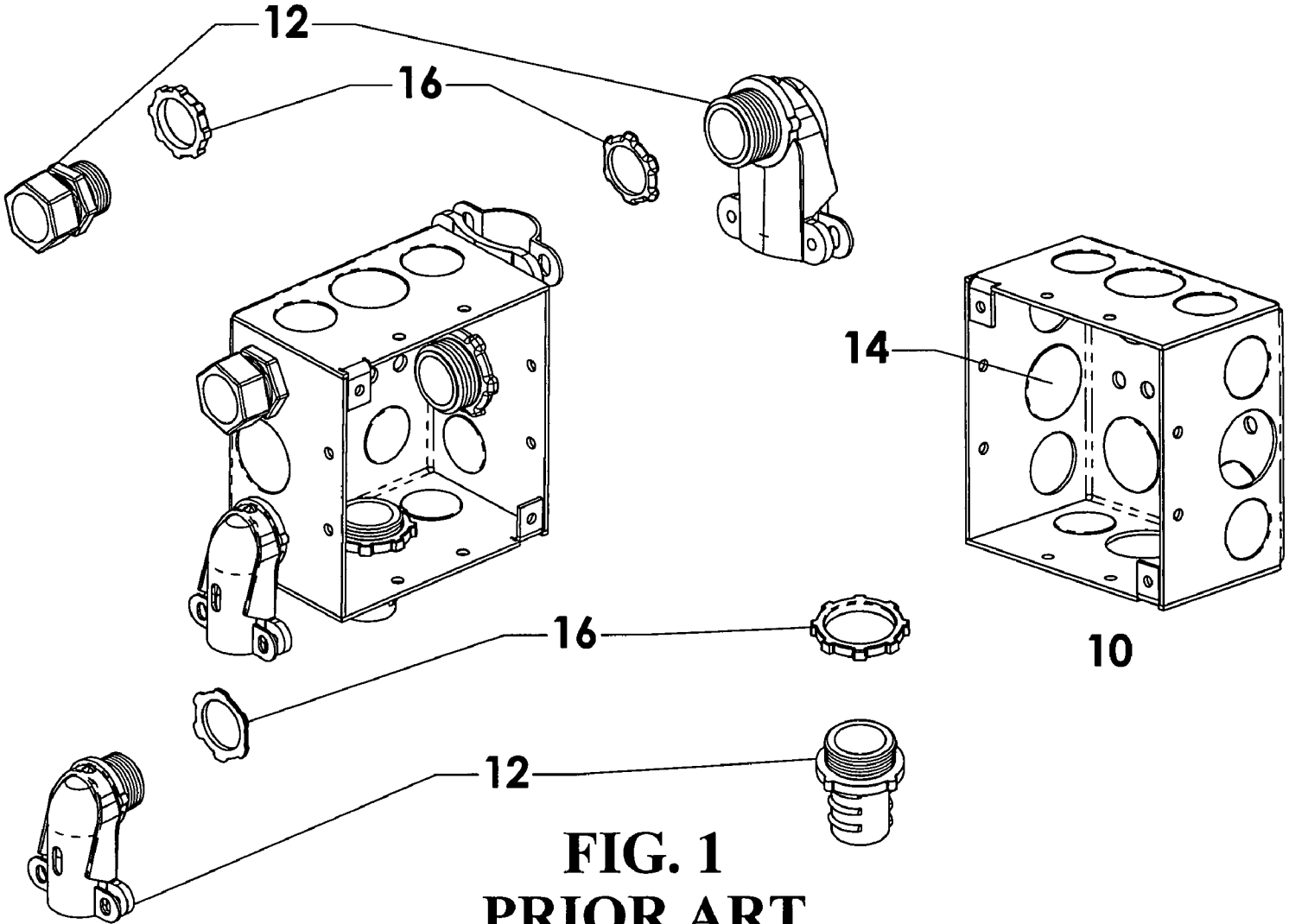
FIG. 1 PRIOR ART
FIG. 1 is an illustration of a typical electrical junction box, fittings and locknuts.
Figure 2B:
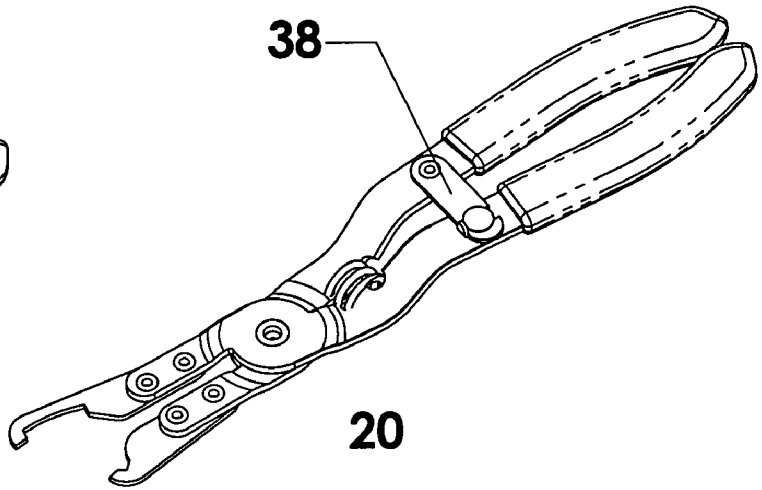
FIG. 2B is a isometric view of the present invention depicting a hand tool in the closed position.
Figure 2A:
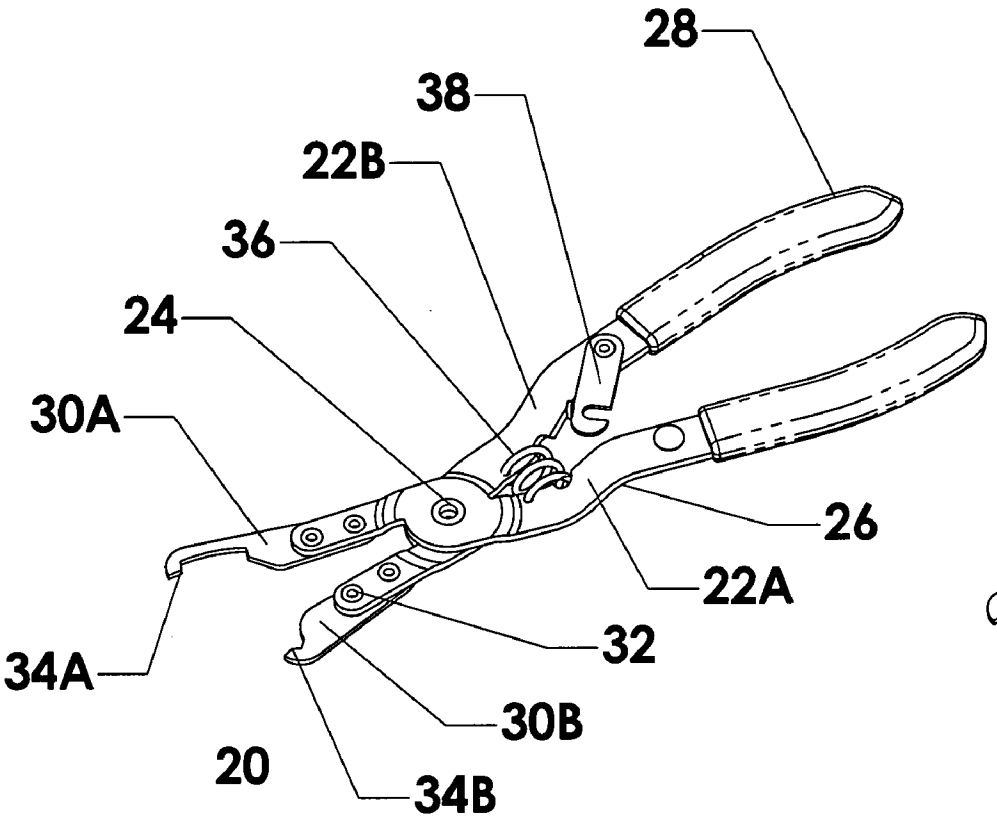
FIG. 2A is a isometric view of the present invention depicting a hand tool in the open position.

The present invention is depicted in FIG. 2A, and comprises a hand tool 20 that includes a first handle 22A and a second handle 22B that rotate about a common pivot point 24. The pivot point 24 can be a mechanical fastener, such as a rivet, screw, or any other such component that will allow the first handle 22A to rotate upon the second handle 22B about the fastener. The first handle 22A and the second handle 22B may be designed in either a straight configuration or alternatively, incorporate an offset 26 in them in order to provide additional clearance for the user's hand when the hand tool 20 is used in confined spaces or tight quarters. The design of the first handle 22A and the second handle 22B may take a multitude of forms depending on the manufacturing method selected. The first handle 22A and the second handle 22B may be made of a variety of materials and may take various shapes or forms consistent with the method of manufacture and the function of the hand tool. Regardless of material, shape, or form of the first handle 22A and the second handle 22B, the hand tool 20 is designed so as to provide a right or left-handed user with the ability to access, grip, and manipulate conduit fitting locknuts and other fasteners regardless of spatial orientation. In one embodiment, the first handle 22A and the second handle 22B may be designed as stamped components and incorporate bends, offsets 26, or other formed features required to impart strength and/or rigidity to the first handle 22A, the second handle 22B, and the hand tool 20. Regardless of the shape of the first handle 22A and the second handle 22B, the hand tool 20 is designed to give the user the ability to access, grip, and manipulate the conduit fitting locknuts regardless of the spatial orientation of the locknuts and is designed so that both right-handed and left-handed persons can utilize the hand tool 20. The proximal end of each of the first handle 22A and the second handle 22B may be covered in an electrically insulating compliant material 28 in order to aid in insulating the hands of the user from electrical shock and cushion the grip of the hand tool 20 while in use. The electrically insulating compliant material 28 may be incorporated into the proximal ends of the first handle 22A and the second handle 22B and this electrically insulating compliant material 28 may incorporate features to enhance the ergonomics of the tool and the grip of the user. The hand tool 20 is designed to be of a thin profile in order for it to be used within the tight confines of typical electrical junction boxes.

Figure 3C:
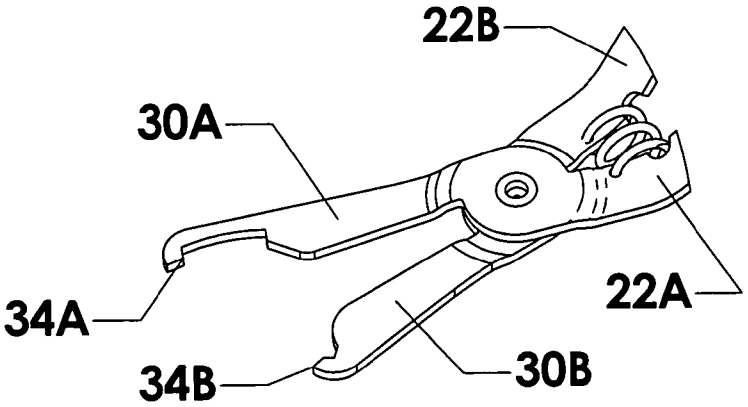
FIG. 3C is a isometric view of the present invention depicting the jaw members as separately attached components with the jaw members gripping a locknut.
Figure 3D:
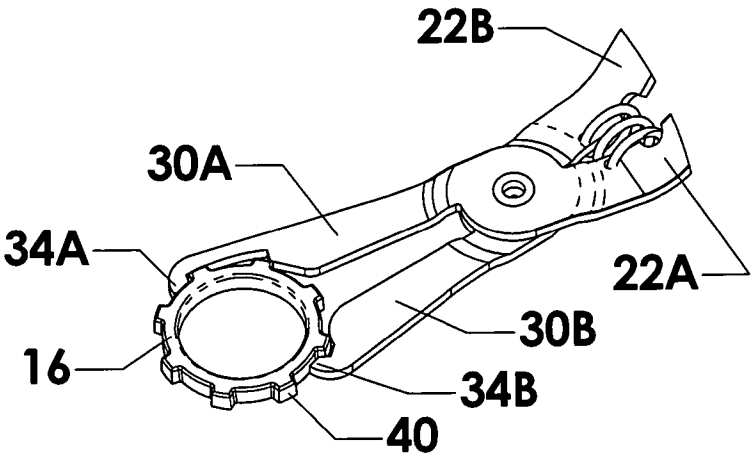
FIG. 3D is a isometric view of the present invention depicting the jaw members incorporated into the design of the handles with the jaw members gripping a locknut.
Figure 3A:
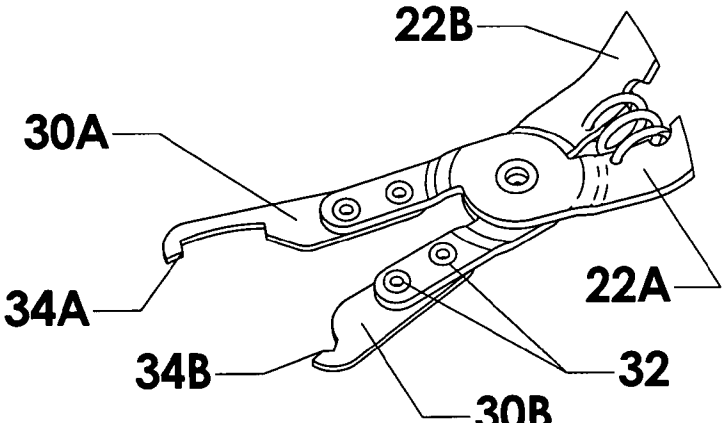
FIG. 3A is a isometric view of the present invention depicting the jaw members as separately attached components.

In one possible configuration as shown in FIG. 3A, a first jaw member 30A and a second jaw member 30B may be affixed to the distal end of the first handle 22A and the second handle 22B respectively. A manner of attaching 32 the first jaw member 30A and the second jaw member 30B to the first handle 22A and the second handle 22B can be a mechanical fastener, such as a rivet or screw or any other such means of attachment, including suitable adhesives, welding or brazing. Alternatively as shown in FIG. 3C, the design of the first jaw member 30A and the second jaw member 30B which are of thin cross-section may be incorporated into and made integral with the design of the first handle 22A and the second handle 22B thus, making the handle/jaw member combination capable of being manufactured from a single piece of material.

Figure 3B:
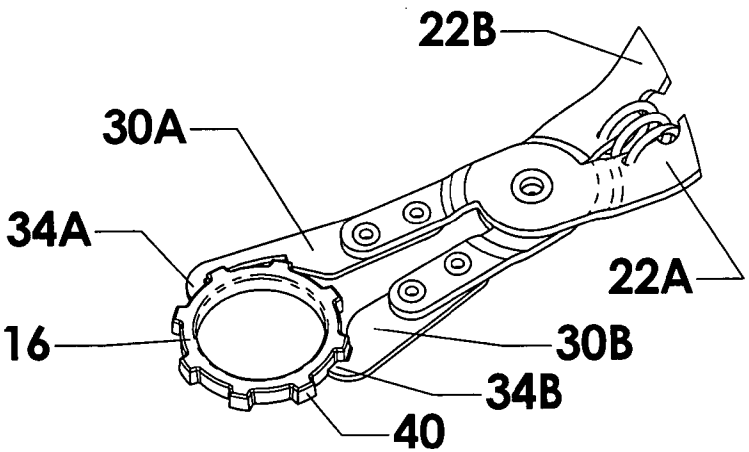
FIG. 3B is a isometric view of the present invention depicting the jaw members incorporated into the design of the handles.
Figure 4A:
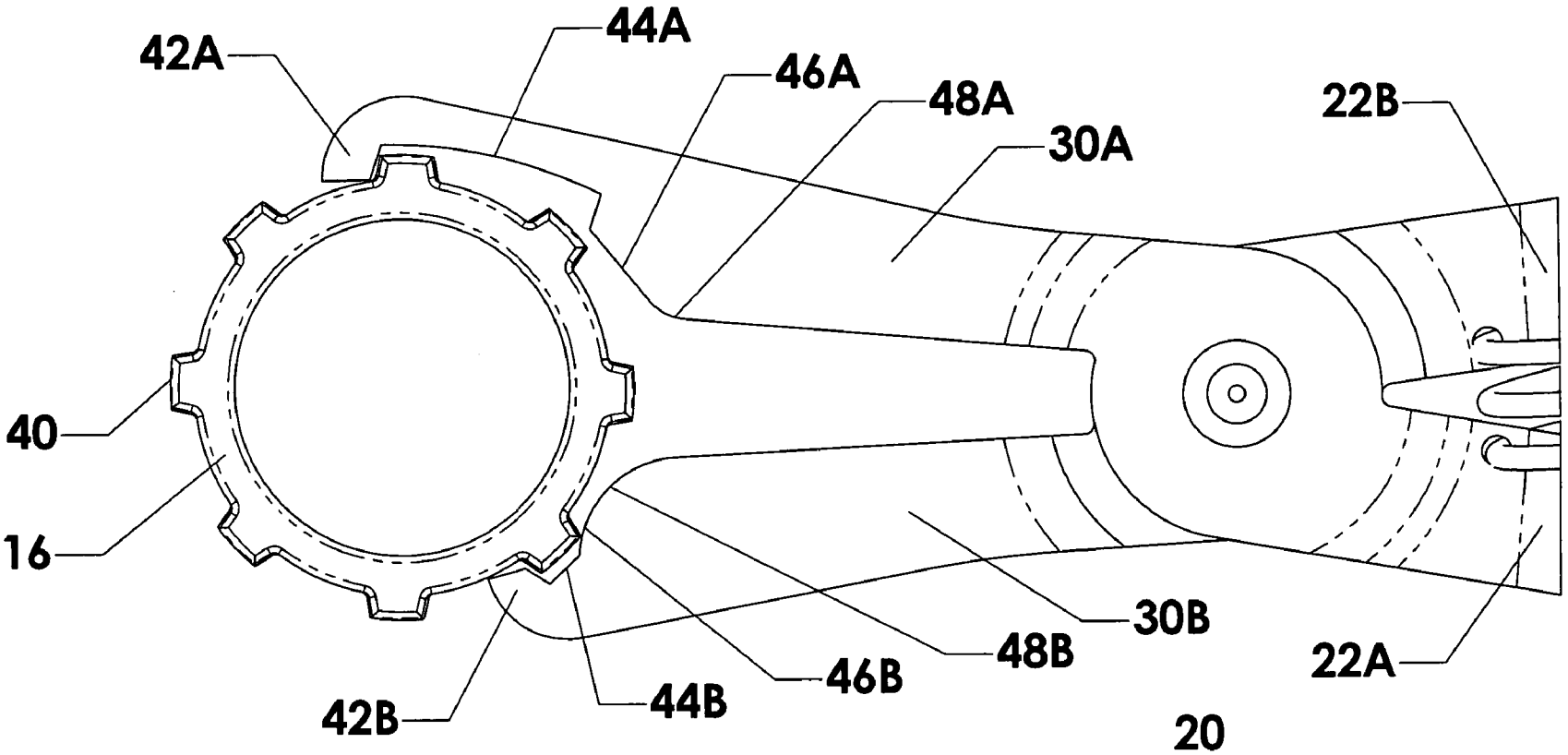
FIG. 4A is an enlarged plan view of the present invention depicting the jaw members engaging a larger locknut.
Figure 4B:
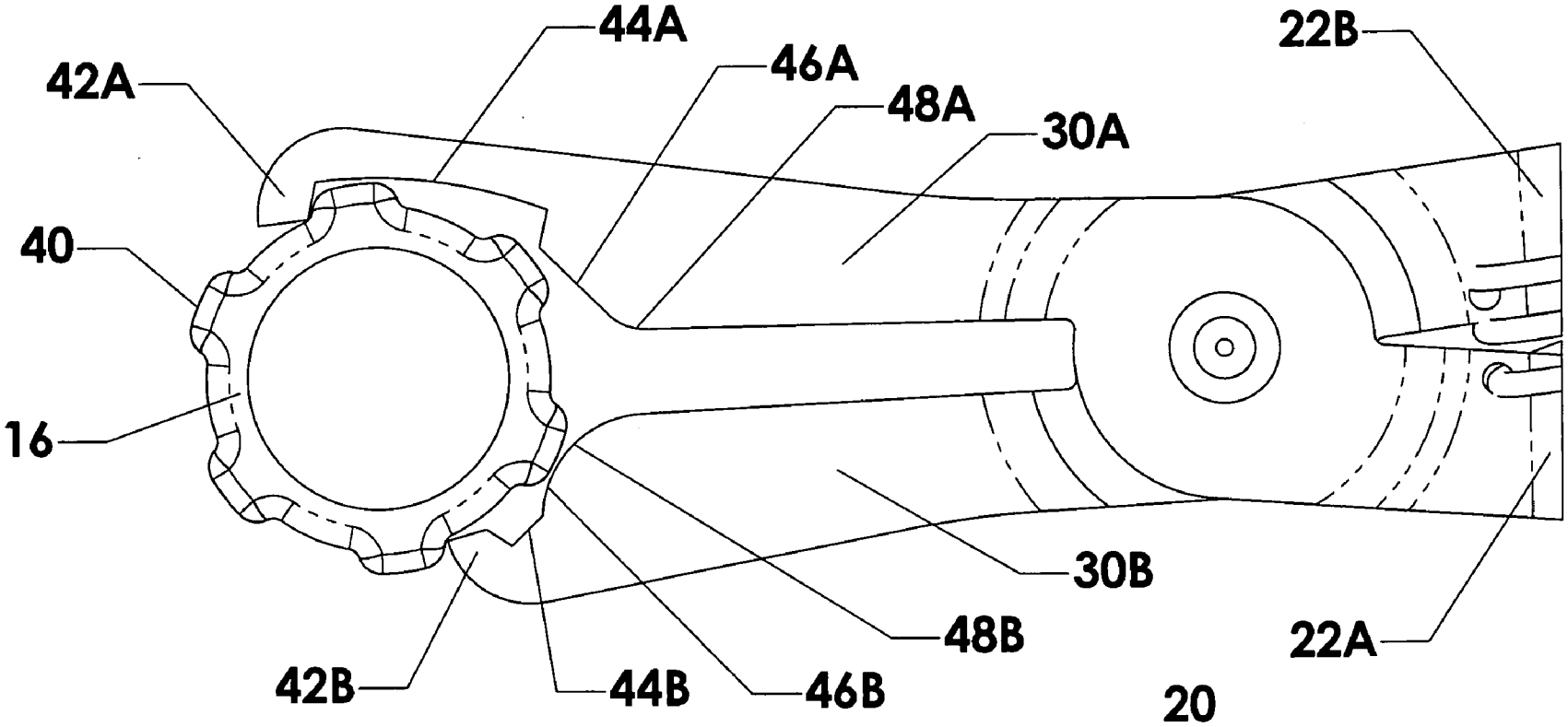
FIG. 4B is an enlarged plan view of the present invention depicting the jaw members engaging a smaller locknut.

In use, the first shape 34A of the portion of the first jaw member 30A and a second shape 34B of the second jaw member 30B grips the conduit fitting locknut. Referring to FIG. 3A, the first shape 34A and the second shape 34B are asymmetrical, unique, and are intended to grip around the various styles and shapes of protrusions which extend from the periphery of the wide variety of locknuts. The first shape 34A of the portion of the first jaw member 30A and the second shape 34B of the second jaw member 30B are designed in such a manner that, when the tool's first handle 22A and second handle 22B are closed, the first jaw member 30A and the second jaw member 30B independently engage one or more of the locknut protrusions. The first jaw member 30A and the second jaw member 30B are of different lengths. Referring to FIGS. 3B, and 3D, the length and the first shape 34A of the portion of the first jaw member 30A and the length and the second shape 34B of the portion of the second jaw member 30B that grip the conduit fitting locknut 16, are unique and are intended to grip around the various sizes, styles, and shapes of lugs or protrusions 40 which extend from the periphery of a wide variety of locknuts. The first jaw member 30A and the second jaw member 30B are designed in such a manner that, when the tool's first handle 22A and second handle 22B are closed, held closed, and a rotational motion along the rotational axis of the locknut is applied, each jaw member independently engages or bears against one or more of the locknut's lugs or protrusions 40, or alternatively, engages or bears against the facets, flats, or other features present on these or other kinds of nuts. As shown in FIGS. 4A and 4B, the design of each jaw member is unique and incorporates one or more hooks 42A and 42B, cutouts 44A and 44B, flats 46A and 46B, and/or protrusions 48A and 48B. These hooks 42A and 42B, cutouts 44A and 44B, flats 46A and 46B, and/or protrusions 48A and 48B enable the first jaw member 30A and the second jaw member 30B to surround and/or bear against the sides and/or ends of the various lugs or protrusions 40, or alternatively, the facets, flats, or other features present on the conduit locknut or other kinds of nuts. These hooks 42A and 42B, cutouts 44A and 44B, flats 46A and 46B, and/or protrusions 48A and 48B may or may not be in the same plane as the hand tool's 20 first handle 22A and second handle 22B when viewed along the rotational axis of the locknut 16. Regardless of their design, such hooks 42A and 42B, cutouts 44A and 44B, flats 46A and 46B, and/or protrusions 48A and 48B are unique and asymmetric with respect to each jaw member when viewed along the rotational axis of the locknut and provide the hand tool with the ability to grip and manipulate all sizes of conduit fitting locknuts 16 and their lugs or protrusions 40 whose diameters fit within the range of opening of the first jaw member 30A and the second jaw member 30B. The unique shapes of the hooks 42A and 42B made by the cutouts 44A and 44B allow the user to place the first jaw member 30A and the second jaw member 30B into the narrow space created when two locknuts are placed side by side or close together. The longer first jaw member 30A and shorter second jaw member 30B design allows the user to grip the locknut so as to allow the maximum movement when rotating the locknut 16. FIG. 4A depicts the hand tool 20 gripping a larger locknut 16 and FIG. 4B depicts the hand tool 20 gripping a smaller locknut 16.

As shown in FIG. 2A, a spring or spring mechanism 36 may be incorporated into the hand tool 20 and is used to maintain the first handle 22A and the second handle 22B and their attached or integral first jaw member 30A and the second jaw member 30B in a normally open position.

A locking mechanism 38 may be incorporated into the hand tool 20 to lock the first handle 22A and the second handle 22B for storage into the closed position against the force of the spring or spring mechanism 36. FIG. 2B depicts the hand tool 20 locked in the closed position.

Figure 5:
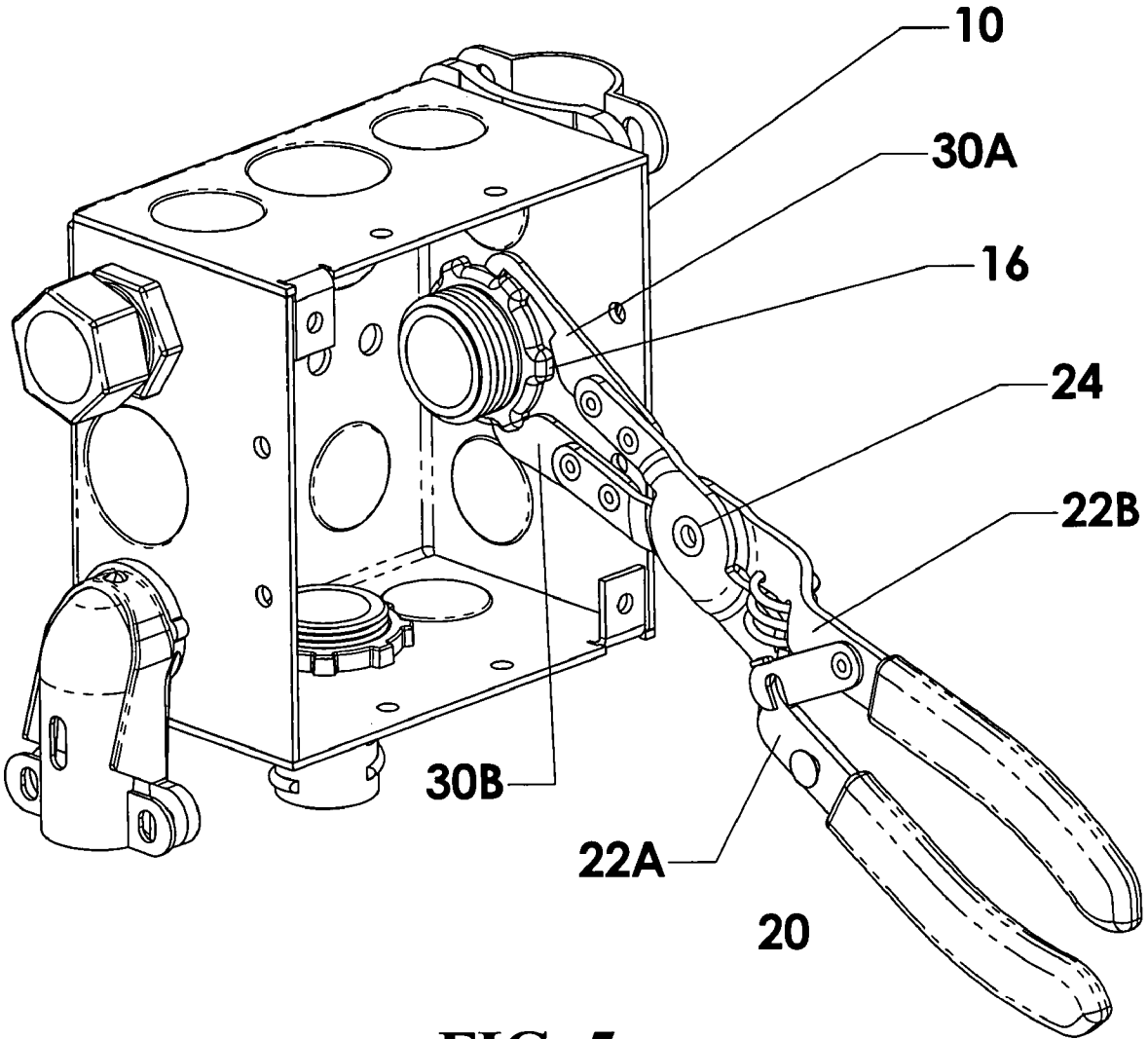
FIG. 5 is an isometric view of the present invention applied to a conduit locknut in a vertical orientation.

(3) Manner of Use:

Assuming that the hand tool 20 is in the locked position as depicted in FIG. 2B, a user first unlocks the hand tool 20. As shown in FIG. 2A, the user opens the first jaw member 30A and the second jaw member 30B. Referring to FIG. 5, the user then grips the first handle 22A and the second handle 22B of the hand tool 20 and orients it in such a manner so as to make the axis that passes through the pivot point 24 of the hand tool parallel to the axis of rotation of the locknut 16 he desires to tighten or loosen. The user then maneuvers the hand tool 20 to place the first jaw member 30A and the second jaw member 30B around the locknut 16 he desires to loosen or tighten and closes the first handle 22A and the second handle 22B in order to make the first jaw member 30A and the second jaw member 30B grip around the circumference of the locknut 16 and engage any protrusions extending from the periphery of the locknut 16. The user then simultaneously rotates the locknut 16 about its axis while maintaining his grip on the first handle 22A and the second handle 22B of the hand tool 20 to facilitate either the tightening or loosening the locknut 16. It is assumed that the user will have to rotate the locknut 16 in small repeated increments due to the normally crowded confines of typical electrical junction boxes 10. As mentioned above, the hand tool 20 may be oriented it in such a manner so as to make the axis that passes through the pivot point 24 of the hand tool parallel to the axis of rotation of the locknut 16. However, the orientation may vary on an arc out to and including an axis that passes through the pivot point 24 of the hand tool perpendicular to the axis of rotation of the locknut 16.

Figure 6:
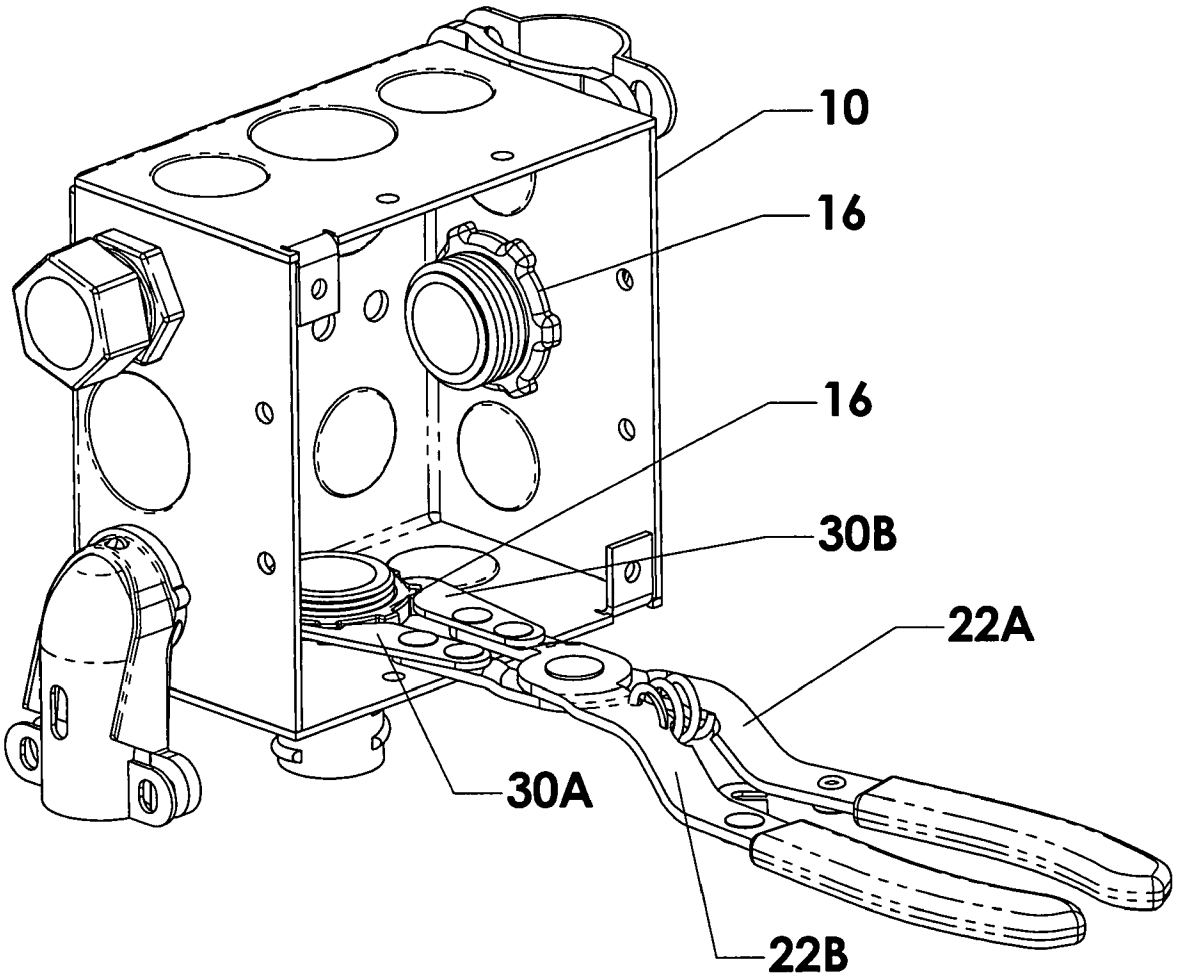
FIG. 6 is an isometric view of the present invention applied to a conduit locknut in a horizontal orientation.

FIG. 6 depicts the typical electrical junction box 10 with the hand tool 20 flipped over. The shape of the first handle 22A and the second handle 22B allows both right-handed and left-handed persons to utilize the hand tool 20 equivalently. In addition, the shape cut into the first jaw member 30A and the second jaw member 30B in combination with the shape and thin cross-section of the first handle 22A and the second handle 22B allows the user to tighten or loosen locknuts 16 regardless of which way the pivot axis of the hand tool 20 is oriented with respect to the axis of rotation of the locknut 16.

(4) Uniqueness:

As depicted in FIG. 2A, the uniqueness of this invention is illustrated in many ways, nine of which are as follows. First, the unique profile of the first shape 34A and the second shape 34B cut into the first jaw member 30A and the second jaw member 30B of the hand tool 20 enables the first jaw member 30A and the second jaw member 30B to grip and securely hold a wide variety of shapes and sizes of locknuts, therefore, one hand tool 20 can be used to manipulate all locknuts whose diameters fit within the range of opening of the first jaw member 30A and the second jaw member 30B. Second, the thin cross-section of the first handle 22A and the second handle 22B and their attached or integral first jaw member 30A and second jaw member 30B enhance the user's ability to utilize the hand tool 20 in confined spaces. Third, the shape of the first handle 22A and the second handle 22B allows both right-handed and left-handed persons to utilize the hand tool 20 equivalently. Fourth, the profile of the first shape 34A and the second shape 34B cut into the first jaw member 30A and the second jaw member 30B in combination with the thin cross-section of the handles 22 allows the user to tighten or loosen locknuts 16 regardless of which way the pivot axis of the hand tool 20 is oriented with respect to the axis of rotation of the locknut 16. FIG. 6 depicts the hand tool 20 oriented horizontally. Fifth, because the first jaw member 30A and the second jaw member 30B can be presented to the locknut 16 perpendicular to the axis of rotation of the locknut 16 and surround it, the hand tool 20 can be used to tighten and loosen locknuts 16 even when wires have already been passed through a conduit fitting. Sixth, referring to FIG. 2A, the hand tool 20 aids in protection of the user from electrical shock by the incorporation of an electrically insulating material 28 covering or incorporated on the proximal end of the first handle 22A and the second handle 22B. Seventh, the incorporation of an ergonomic gripping surface into the electrically insulating material 28 attached to or surrounding the proximal end of the first handle 22A and the second handle 22B enhances and cushions the user's grip. Eight, the incorporation of a spring or spring mechanism 36 which serves to maintain the first jaw member 30A and the second jaw member 30B in an opened position makes the tool easier for the user to manipulate since he only has to squeeze first handle 22A and the second handle 22B in order to maneuver a locknut subsequently gripped between the first jaw member 30A and the second jaw member 30B. Ninth, as shown in FIG. 2B, the incorporation of a latch 38 allows the user to store the tool in a compact, safe, closed configuration.

What is claimed is:

1. A hand tool for tightening and locking differently sized locknuts, the hand tool comprising:

a first member having a proximate end comprising a first handle and a distal end comprising a first jaw;

a second member having a proximate end comprising a second handle and a distal end comprising a second jaw;

a pivot member comprising means for operably connecting said first and second members, said pivot member being disposed between the handles and the jaws so that the jaws pivot with movement of the handles;

said first jaw being more distally disposed than the second jaw;

said first jaw comprising a first elongate notch, and said second jaw comprising a second elongate notch, said first notch being more elongate than the second notch, said first notch comprising an elongate wall and an adjacent transversely disposed distal wall;

wherein with said jaws closed on a first locknut, said first notch distal wall frictionally engages a first lug and the adjacent elongate wall is spacedly disposed from the first lug, and said second notch straddles a second lug of the first locknut; and wherein said jaws are closed on a second locknut having a smaller diameter than the first locknut, the first notch distal wall frictionally engages a first lug with the adjacent elongate wall spacedly disposed from the first lug, and the second notch does not straddle a second lug of the second locknut, said second notch comprises a proximately disposed adjacent convex curvilinear wall, said curvilinear wall is proximately disposed from said first and second notches, whereby said curvilinear wall frictionally engages a lug of a said first locknut with the jaws closed on the first locknut.

2. The hand tool of claim 1, said first notch elongate wall and distal wall are in angular disposition.

3. The hand tool of claim 1, further comprising a distally disposed corner immediately adjacent to the distal wall.

4. The hand tool of claim 1, said curvilinear wall does not frictionally engage a lug of the second locknut with the jaws closed on the second locknut.

5. The hand tool of claim 1, said second jaw comprises a distally disposed edge, said distally disposed edge frictionally engages each respective locknut at a portion between respective adjacent lugs with the jaws closed on each said locknut.

6. The hand tool of claim 1, wherein the means for operably connecting the members is not transversely movable, with respect to the members.

7. The hand tool of claim 1, wherein the first notch distal wall is a planar surface.

8. The hand tool of claim 1, said second notch comprises a distal end and a proximate end, and further comprises rectilinear surfaces disposed at the distal end of the second notch.

9. The hand tool of claim 8, said first notch distal wall being distally disposed from the second notch rectilinear surfaces.

* * * * *